US007980927B2

(12) United States Patent
Price

(10) Patent No.: US 7,980,927 B2
(45) **Date of Patent: *Jul. 19, 2011**

(54) FUME HOOD WITH FLOOR ACCESS OPENING

(75) Inventor: Robert G. Price, Wilmington, NC (US)

(73) Assignee: Flow Sciences, Inc., Leland, NC (US)

( * ) Notice: Subject to any disclaimer, the term of this patent is extended or adjusted under 35 U.S.C. 154(b) by 1589 days.

This patent is subject to a terminal disclaimer.

(21) Appl. No.: 11/113,919

(22) Filed: Apr. 25, 2005

(65) Prior Publication Data

US 2006/0240759 A1 Oct. 26, 2006

(51) Int. Cl.
*B08B 15/02* (2006.01)

(52) U.S. Cl. ..... 454/49; 454/56; 454/57; 454/58; 454/59

(58) Field of Classification Search ..... 454/49, 454/56–59
See application file for complete search history.

(56) References Cited

U.S. PATENT DOCUMENTS 3,383,841 A * 5/1968 Olson et al. ..... 55/337
3,548,830 A * 12/1970 Brinckmann et al. ..... 606/125
3,747,505 A * 7/1973 Turko ..... 454/59
4,040,042 A * 8/1977 Mayer ..... 454/340
4,534,281 A * 8/1985 Parks et al. ..... 454/59
4,566,293 A 1/1986 Arner et al.
4,685,385 A * 8/1987 Rich ..... 454/52
4,856,420 A * 8/1989 Poblete et al. ..... 454/59
5,170,673 A * 12/1992 Ahmed et al. ..... 73/865.9
5,232,152 A * 8/1993 Tsang ..... 236/44 A
5,257,957 A 11/1993 Diccianni et al.
5,262,578 A 11/1993 Hall
5,322,095 A 6/1994 Bolz
5,394,861 A * 3/1995 Stegmaier ..... 126/299 D
5,447,468 A * 9/1995 Tener et al. ..... 454/58
5,556,331 A * 9/1996 Bastian ..... 454/56
5,697,838 A * 12/1997 Morris ..... 454/62
5,716,267 A * 2/1998 Hambleton et al. ..... 454/56
5,797,790 A * 8/1998 Rindoks et al. ..... 454/59
5,882,254 A * 3/1999 Jacob ..... 454/61
5,890,781 A 4/1999 Ryder
5,988,860 A * 11/1999 Hefferen et al. ..... 700/276
6,044,838 A * 4/2000 Deng ..... 126/299 D
6,302,779 B1 * 10/2001 Ryan et al. ..... 454/61
6,350,194 B1 * 2/2002 Haugen et al. ..... 454/56
6,428,408 B1 * 8/2002 Bell et al. ..... 454/56
6,431,975 B1 * 8/2002 Ryan ..... 454/49
6,461,233 B1 * 10/2002 Gilkison et al. ..... 454/57
6,534,021 B1 * 3/2003 Maus ..... 422/180
6,582,292 B1 * 6/2003 Bastian ..... 454/59
6,634,939 B2 * 10/2003 Johnson ..... 454/238
(Continued)

*Primary Examiner* — Steve McAllister
*Assistant Examiner* — Helena Kosanovic
(74) *Attorney, Agent, or Firm* — MacCord Mason PLLC

(57) ABSTRACT

A fume hood is described for use in removing material from, or inserting material into, the opening of a container. The fume hood enclosure has a floor with an opening for insertion of the upper end of the container into the enclosure. The floor includes a circumferential groove around the opening, preferably in a raised shoulder. An annular flexible membrane having an inner diameter smaller than the diameter of the opening is placed in axial alignment over the opening and the groove. A vacuum is drawn on the groove through a vacuum port to pull the section of the membrane above the groove into the groove, holding the membrane securely in place during use. If desired, a retainer can be placed in the groove above the membrane to prevent movement of the membrane in the event of a loss of vacuum.

13 Claims, 4 Drawing Sheets

U.S. PATENT DOCUMENTS 6,659,857 B2 * 12/2003 Ryan et al. ..... 454/56
6,675,940 B2 * 1/2004 Maurice ..... 188/171
6,871,170 B2 * 3/2005 Ryan et al. ..... 703/9
7,063,329 B2 * 6/2006 Anderson et al. ..... 277/626

* cited by examiner

FUME HOOD WITH FLOOR ACCESS OPENING

BACKGROUND OF THE INVENTION (1) Field of the Invention

The present invention relates to improved fume hoods or ventilated workstations having a floor opening through which the upper end of a container is inserted into the hood enclosure, and in particular to a method and apparatus for securing a flexible sealing membrane around the floor opening.

(2) Description of the Prior Art

Fume hoods or vented workstations are used in laboratories and other environments to manipulate materials that might generate noxious or dangerous gases or fumes without releasing the materials or components or fumes therefrom into the work environment. Generally, these workstations are comprised of an enclosure or chamber in which materials are handled, and means for drawing air through a front opening in the enclosure. The operator also uses this front opening as the means of access into the enclosure. The enclosure also includes an exhaust opening, frequently communicating with a filter, to remove contaminants from air exhausted from the chamber.

When working with hazardous or toxic material, there is frequently a need to remove materials from a container, to insert materials into a container, or to transfer material from one container to another container. Some of these containers, which may be carboys, drums, or the like, are quite large and difficult to maneuver. Therefore, placement of one or more of these containers into a fume hood to prevent escape of hazardous materials into the surrounding environment, as well as their subsequent removal, and the insertion or transfer of materials to or from these containers, can be difficult, if not impossible.

Commonly assigned U.S. Pat. No. 6,431,975 to Ryan, incorporated herein by reference in its entirety, provides an apparatus addressing this need. The Ryan fume hood is comprised of an enclosure that includes at least one container-receiving opening in the floor of the enclosure. The enclosure is supported so that a large container having a top opening through which material can be added to, or removed from, can be positioned beneath the enclosure and then raised upwardly, so that the upper section of the container projects through the opening and into the enclosure.

The operator can then open the container from within the enclosure, remove or add material, and then close the container. The container is then lowered to separate the container from the enclosure. As a result, the opening into the container is at all times within the fume hood enclosure when the container is open, thereby preventing hazardous materials from escaping from outside the hood enclosure. As used herein, the term "hazardous" is broadly intended to include all materials, whether in powder, liquid or gaseous form, where escape beyond a confined area is undesirable, and the term "container" is intended to include all containers for such materials.

In order to create a flexible seal between the container and the floor when the container is inserted through the opening, thereby preventing leakage of gases into or out of the enclosure, an annular flexible sealing member or membrane is positioned around the opening, with the inner diameter of the membrane being less than the diameter of the opening. In the Ryan apparatus, this membrane is held in place by rings that clamp the membrane to the floor.

Attachment of membranes around the hood floor opening with clamped rings as described by Ryan can be time-consuming and achieving a complete seal can be difficult. Moreover, the rings and clamps may become contaminated during use of the fume hood, requiring decontamination or disposal. Therefore, there is a need for an apparatus and method for quickly and securely attaching membranes around a floor opening in fume hoods of the type described in the Ryan patent, and in particular to a means of membrane attachment that eliminates the use of rings and clamps requiring decontamination or disposal.

SUMMARY OF THE INVENTION

The present invention relates to fume hoods of the general type described in the Ryan patent that include a floor access opening, modified to provide an improved means for membrane attachment.

Generally, the fume hood is comprised of an enclosure for holding hazardous materials, a means for drawing air through the enclosure and from the enclosure, normally through an exhaust plenum to a filter to remove hazardous materials. The enclosure is defined by a pair of spaced, parallel side walls; rear and upper walls joining the side walls; and a horizontal bottom wall or floor. The front edges of the side, upper and bottom walls together form an access opening or inlet into the chamber through which the operator can manipulate material within the chamber. Air also enters the chamber through this access opening.

The enclosure may also include a moveable closure or door to vary the size of the access opening. An air exhaust opening leading to an exhaust plenum is preferably located on the opposite side of the chamber from the access opening, so that air flows across the chamber from the access opening to the discharge opening. The sidewalls, front and/or upper walls of the enclosure are preferably of a clear, impact resistant plastic to facilitate viewing of the chamber contents.

The bottom wall or floor of the enclosure is preferably comprised of a planar work surface with rear and side edges joining the rear and side walls, respectively, of the enclosure. At least one container-receiving opening extends through the floor. Preferably, the opening is large enough to accommodate the largest container to be used, and is of a shape corresponding to the cross-section of the container. That is, a round opening will preferably be used for cylindrical containers, such as drums or carboys, while a rectangular opening will be used for rectangular containers, such as boxes.

Escape of contaminated air from the hood chamber through the access opening into the work environment is prevented by maintaining a pressure differential between the chamber, or hood interior, and the work environment, or hood exterior, so that air continually flows from the hood exterior through the access opening into the hood interior. A sufficient air velocity at the access opening, known as the "face velocity," must be maintained to prevent contaminated air from escaping.

Contaminated air is exhausted from a fume hood through an exhaust conduit that includes a vacuum source to draw the air through the exhaust conduit. Generally, this vacuum source is comprised of an exhaust fan positioned within the conduit, and an electric motor to turn the fan. The gas may be exhausted to the exterior environment when toxic contaminants are not present. In many instances, however, the air will be conveyed through a filter, such as a HEPA filter, to remove contaminants from the air.

The enclosure is supported so that the lower surface of the enclosure floor is supported above the floor or other surface at a height at least equal to the height of the container to be emptied, so that the container can be positioned beneath the enclosure before being raised into the opening. Since some containers may be quite heavy, and since the container must be held in the raised position during addition or removal of material, the container is preferably supported on a vertically adjustable platform, such as a wheeled carrier that can be rolled into position beneath the enclosure. If so, the enclosure will be supported at a height sufficient to permit insertion of the platform and a container carried on the platform when the platform is in the lowered position. Thus, the overall system will be comprised of the fume hood, a hood base or support, and the vertically adjustable container carrier.

Instead of using clamped rings to secure the membrane around the floor opening as described in the Ryan patent, the enclosure floor in the present invention includes a continuous groove extending around the floor opening, with a vacuum port in the groove wall. A vacuum source, e.g., a vacuum pump powered by an electric motor, is attached to the port. A flexible conduit with an in-line shutoff valve can extend from the pump to the port for this purpose. A cover may also be provided to fit over the opening when the opening is not used for container insertion.

The membrane used to seal the opening is an annular membrane with an outer diameter and a central inner opening, the inner opening being of a smaller diameter than the diameter of the floor opening so that a segment of the membrane extends inwardly beyond the floor opening edge when the membrane is in place. The exterior edge of the membrane extends beyond the outer edge of the groove, preferably by a length that is approximately equal to the depth of the groove. That is, the outer diameter of the membrane is approximately equal to the diameter of the opening plus the depth of the groove. The membrane may be of rubber of other flexible, resilient material.

In a preferred embodiment, the floor opening is surrounded by an annular shoulder, e.g., a raised floor section, with a planar upper surface. In this embodiment, the groove is cut into the upper surface of the shoulder. The outer periphery of the shoulder may generally correspond to the outer periphery of the membrane. When present, the upper surface of the floor opening cover will lie in a plane with the upper surface of the shoulder when the cover is over the opening.

In order to install the membrane, a membrane is concentrically positioned around the floor opening and over the groove. If the shoulder and cover are present, the membrane will rest on the shoulder and cover. The vacuum pump is then started, drawing a vacuum in the groove to pull the periphery of the membrane over the groove into the groove, holding the membrane securely in place.

As a safety feature, the hood may also include a retainer that is insertable into the groove over the section of membrane within the groove. Preferably, the retainer is compressible to fit snugly against the membrane section, pressing the membrane section against the groove side walls. For example, the retainer may be a length of Tygon or medical tubing having a diameter approximately equal to the width of the groove and a length approximately equal to the length of the groove.

To hold the membrane securely in the groove, the width of the groove at its upper edges is preferably less than the horizontal width of the groove at a point beneath the upper edges of the groove, i.e., the groove expands outwardly beneath its upper edges. For example, the vertical cross-section of the groove may be a truncated triangle with an open top inwardly inclined side walls and a bottom wall or floor that has a width greater that the width separating the upper edges of the groove opening. This latter configuration also provides a more secure fit for the membrane by leaving vacuum pockets on either side of the membrane, so that a vacuum will be drawn around the entire groove. Additional membranes can be placed above this membrane and ballasted in position.

DETAILED DESCRIPTION OF THE PREFERRED EMBODIMENTS

Figure 1:
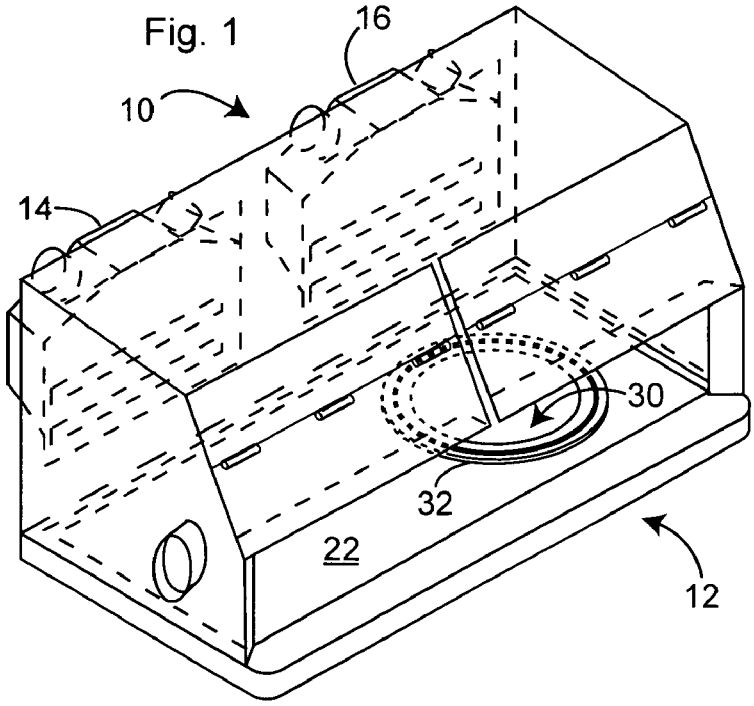
FIG. 1 is a perspective view of a fume hood with a floor opening and a membrane held in place in accordance with the present invention.
Figure 2:
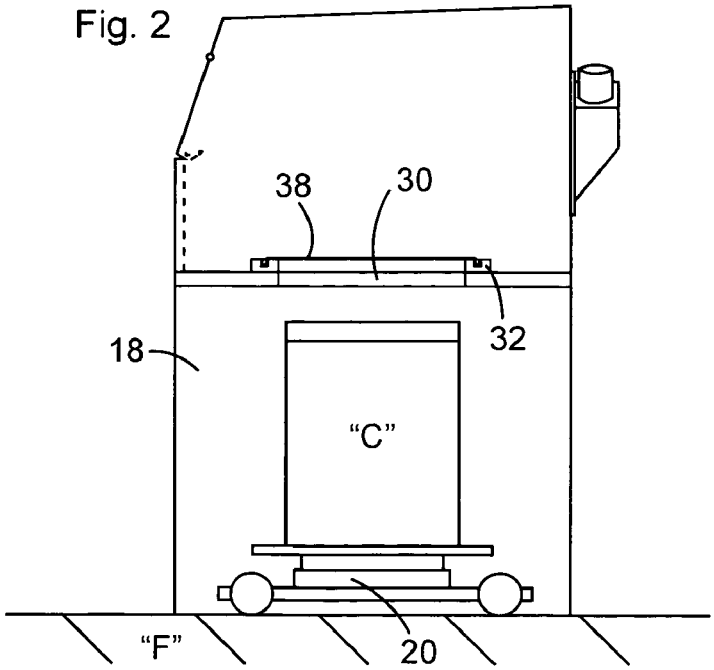
FIG. 2 is a side view of the fume hood raised for insertion of a container.
Figure 3:
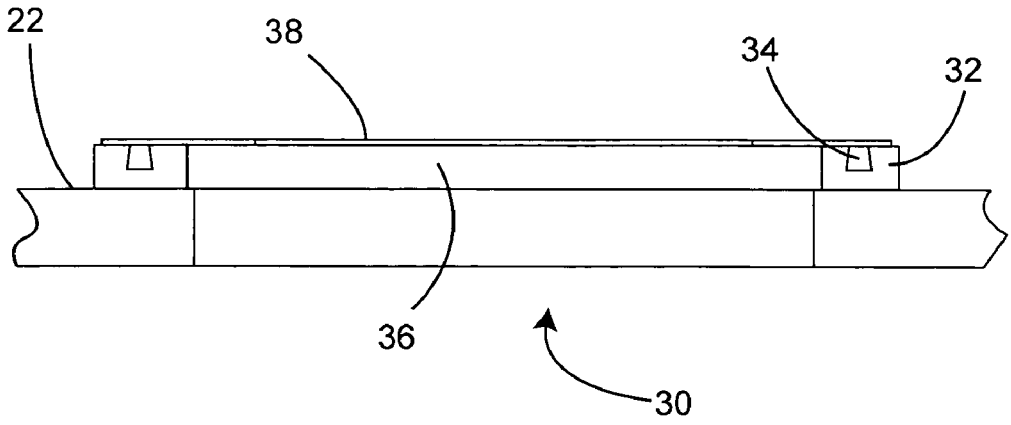
FIG. 3 is a sectional side view of a fume hood floor with a floor opening and a membrane prior to being held in place in accordance with the present invention.
Figure 4:
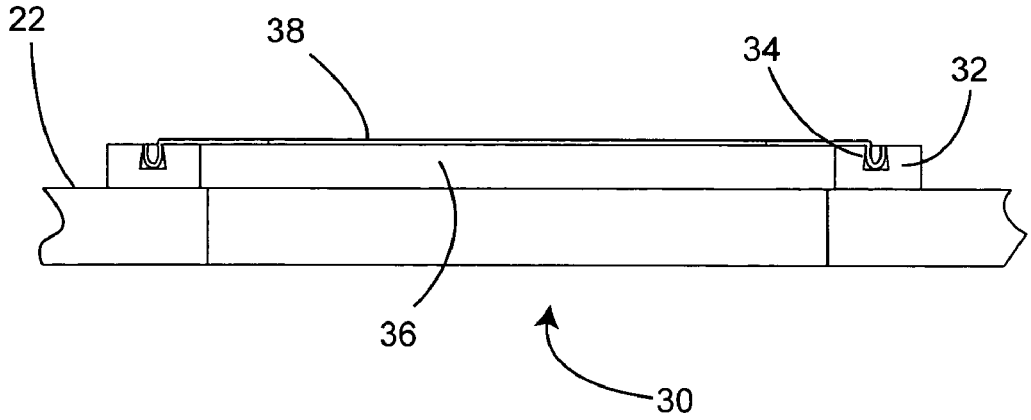
FIG. 4 is a sectional side view of a fume hood floor with a floor opening and a membrane held in place in accordance with the present invention.

FIGS. 1 and 2 illustrate a typical fume hood, generally 10, incorporating the membrane holding device of the invention. Hood 10 is comprised of an enclosure, generally 12, with attached plenums 14 and 16 that are in communication with the interior of enclosure 12. Hood support 18 supports hood 10 above floor "F", so that container carrier 20 and container "C" can be moved beneath enclosure 12.

Enclosure 12 includes a floor 22 with a container insertion opening 30, shown as a circular opening in the preferred embodiment. It will be appreciated that the hood may contain more than one floor opening for insertion of large containers. As best illustrated in FIGS. 3-6, opening 30 is surrounded by annular raised shoulder 32 that includes circumferential groove 34. When not in use, opening 30 is covered with cover 36.

Figure 5:
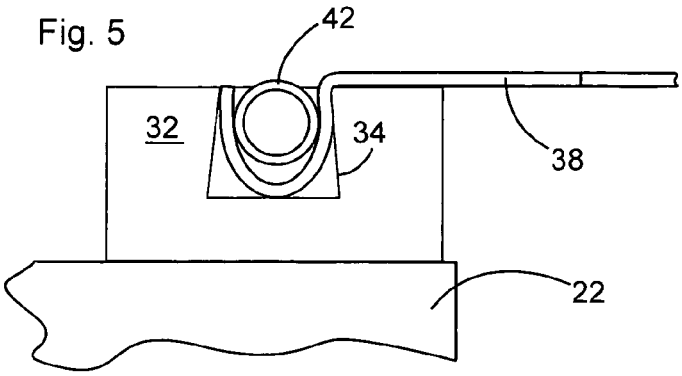
FIG. 5 is a detailed sectional side view of a flexible membrane held within the shoulder groove, and including the optional locking member.
Figure 6:
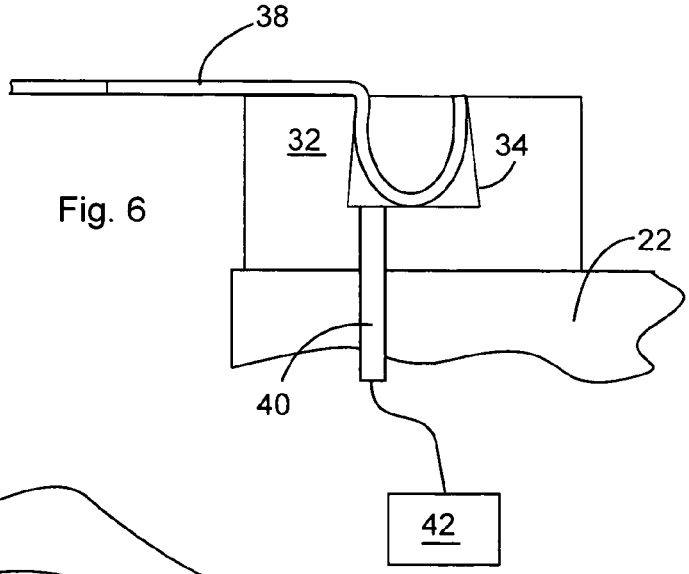
FIG. 6 is a detailed sectional side view of a flexible membrane held within the shoulder groove, and illustrating the vacuum port in communication with a vacuum pump.
Figure 7:
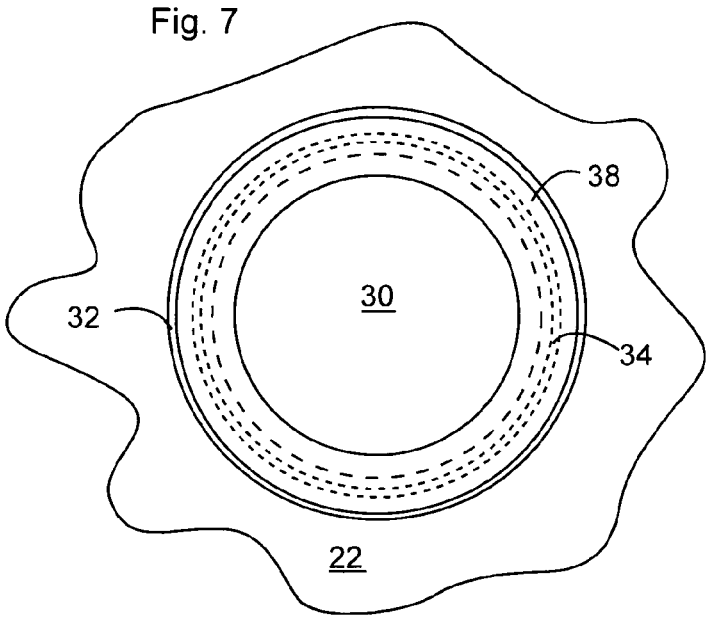
FIG. 7 is a top view of a section of the fume hood floor showing the floor opening with a flexible membrane positioned around the opening and above the continuous groove.

As illustrated in FIG. 2, membrane 38 is initially placed on top of shoulder 32 and cover 36, and axially aligned with opening 30. A vacuum is drawn through vacuum port 40, shown in FIG. 5, by vacuum pump 42 to draw the periphery of membrane 38 into groove 34. As shown in FIGS. 5 and 6, the diameter of membrane 38 is approximately equal to the diameter of opening 30 plus the depth of groove 34. A membrane of a lesser diameter will not fit as securely in groove 38, and a membrane of a larger diameter may drape, causing wrinkles and potential leakage.

Since the width of groove 34 in the preferred embodiment is greater than the width of the upper edge of groove 34, a space will remain at the lower part of groove 34 between membrane 38 and the inner wall of groove 34, permitting a continuous vacuum to be drawn on membrane 38. As a precaution in the event of a vacuum pump failure, a locking retainer, shown as a section of Tygon or medical grade tubing 42 having a length approximately equal to the length of groove 34 may optionally be inserted into groove 34 above membrane 38 after membrane 38 is drawn into groove 34.

After membrane 38 is secured in place, cover 36 is removed and a container "C" is raised upwardly through opening 30 so that the upper end of container "C" protrudes into enclosure 12. Flexible membrane 38 stretches to form an airtight fit against the side wall of container "C". When no longer used, container "C" is withdrawn and the vacuum is terminated. Membrane 38, no longer held in groove 34 by the vacuum can be simply lifted off of floor 22 for disposal.

Figure 8:
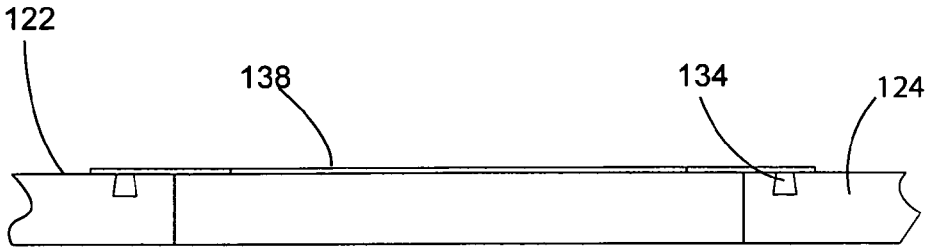
FIG. 8 is a sectional side view of a horizontal fume hood floor with a planar work surface and a floor opening surrounded by a circumferential groove, and a membrane prior to being held in place in accordance with the present invention.
Figure 9:
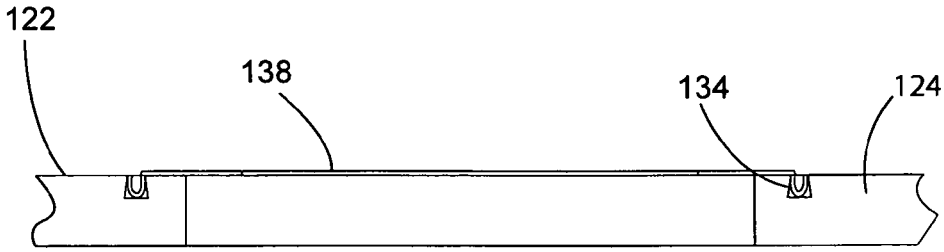
FIG. 9 is a sectional side view of a horizontal fume hood floor with a planar work surface and a floor opening surrounded by a circumferential groove, and a membrane held in place in accordance with the present invention.

As illustrated in FIG. 8, membrane 138 is initially placed on the planar work surface 122 of horizontal floor 124 and axially aligned with opening 130 and continuous groove 134 around opening 130. FIG. 9 illustrates the periphery of membrane 138 drawn into groove 134.

Certain modifications and improvements will occur to those skilled in the art upon reading the foregoing description. It should be understood that such modifications and improvements have been deleted herein for the sake of conciseness and readability but are properly within the scope of the following claims.

What is claimed is:

1. A fume hood for use in accessing the upper end of a container comprising;

a) an enclosure having a horizontal floor with a planar work surface and an opening with a first given diameter to receive the upper end of a container, said floor including a raised horizontal surface with a circumferential groove with a second given diameter around said opening and a vacuum port extending around said opening, said groove having an upper edge with a first width and a floor with a second width greater than said first width, whereby vacuum pockets are left on either side of the membrane so that a vacuum can be drawn around the entire groove;

b) a vacuum source in communication with said groove through said port;

c) a flexible annular membrane having an inner diameter less than said first given diameter and an outer diameter greater than said second given diameter positionable around said opening on said planar surface and over said groove, whereby a vacuum drawn in said groove pulls a part of said membrane into said groove to hold said membrane around said opening; and d) a retainer insertable above said membrane within said groove.

2. The hood of claim 1, further including a cover positionable over said opening.

3. The hood of claim 1, further including an annular raised shoulder with an upper surface around said opening, said groove being within the upper surface of said shoulder.

4. The hood of claim 2, wherein said cover has an upper surface in a plane with said floor when said cover is positioned over said opening.

5. The hood of claim 1, wherein said membrane is a rubber membrane.

6. A fume hood for use in accessing the upper end of a container comprising:

a) an enclosure having a floor with an opening with a first given diameter to receive the upper end of a container;

b) an annular raised shoulder around said opening, said shoulder having an upper surface and a continuous annular groove in said upper surface between the inner and outer edges of said shoulder, said groove including a vacuum port opening;

c) a vacuum source in communication with said groove through said port;

d) a flexible annular membrane having an inner diameter less than the diameter of said opening and an outer diameter greater than the diameter of said groove positionable around said opening and said groove, whereby a vacuum drawn in, said groove pulls a part of said membrane into said groove to hold said membrane around said opening; and e) a retainer insertable above said membrane within said groove.

7. The hood of claim 6, wherein said vacuum. source is comprised of a vacuum pump.

8. The hood of claim 6, wherein. said groove has an upper edge with a first width and a floor with a second width greater than said first width, whereby vacuum pockets are left on either side of the membrane so that a vacuum can be drawn around the entire groove.

9. The hood of claim 6, further including a cover positionable over said opening.

10. The hood of claim 9, wherein said cover has an upper surface in a plane with said. floor when said cover is positioned over said opening.

11. A method of retaining an annular flexible membrane around an. opening in a horizontal fume hood floor with a planar work surface and an annular raised shoulder with an upper surface and inner and outer edges around said opening comprising:

a) providing a continuous annular groove in said shoulder upper surface between the inner and outer edges of said shoulder, said groove including a vacuum port;

b) positioning said membrane around said opening and over said groove;

c) creating a vacuum in said groove, whereby a part of said membrane is drawn into said groove and held by said vacuum; and d) inserting a retainer into said groove over said membrane after creating said vacuum.

12. The method of claim 11, whereby said groove has an upper width and a lower width, said lower width being greater than said upper width, whereby vacuum pockets are left on either side of the membrane so that a vacuum can be drawn around the entire groove.

13. The method of claim 11, wherein groove has a given depth and an outer edge, said membrane extending beyond the outer edge of said groove by a length approximately equal to said given, depth when said membrane is positioned around said opening and over said groove.

* * * * *